US005687847A

United States Patent [19]

Culpepper et al.

[11] Patent Number: 5,687,847

[45] Date of Patent: Nov. 18, 1997

[54] CARTON HAVING DIVIDER PANEL FOR TWO-TIER CAN PACKAGE

[75] Inventors: Will L. Culpepper, Covington; James R. Oliff, Austell, both of Ga.

[73] Assignee: The Mead Corporation, Dayton, Ohio

[21] Appl. No.: 532,695

[22] PCT Filed: Apr. 19, 1994

[86] PCT No.: PCT/US94/04266

§ 371 Date: Mar. 20, 1996

§ 102(e) Date: Mar. 20, 1996

[87] PCT Pub. No.: WO94/24014

PCT Pub. Date: Oct. 27, 1994

Related U.S. Application Data

[63] Continuation-in-part of Ser. No. 49,787, Nov. 19, 1993, abandoned.

[51] Int. Cl.[6] ..... B65D 75/00

[52] U.S. Cl. ..... 206/430; 206/427; 206/199; 206/821; 53/157; 53/447

[58] Field of Search ..... 206/158, 199, 206/201, 203, 427, 430, 564, 821; 53/156, 157, 445, 447, 467, 474, 566; 493/352, 354

[56] References Cited

U.S. PATENT DOCUMENTS

| | | | |
|---|---|---|---|
| 2,832,522 | 4/1958 | Schlanger | 229/406 |
| 3,060,816 | 10/1962 | Martin | 493/365 |
| 3,200,944 | 8/1965 | Rapata | 206/161 |
| 3,224,575 | 12/1965 | Whiteford | 206/51 |
| 3,250,564 | 5/1966 | Stern et al. | 294/87.2 |
| 3,351,264 | 11/1967 | Bostrom | 229/120.32 |
| 4,216,861 | 8/1980 | Oliff | 206/427 |
| 4,518,377 | 5/1985 | Skinner | 493/58 |
| 4,637,811 | 1/1987 | Fortney | 493/167 |
| 4,741,729 | 5/1988 | Edwards | 493/339 |
| 4,778,439 | 10/1988 | Alexander | 493/169 |
| 4,789,063 | 12/1988 | Hammett | 206/432 |
| 5,073,162 | 12/1991 | Campbell et al. | 493/396 |
| 5,197,656 | 3/1993 | Hoell et al. | 206/427 |
| 5,221,042 | 6/1993 | Oliff | 229/117.13 |
| 5,246,113 | 9/1993 | Schuster | 206/430 |

*Primary Examiner*—David T. Fidei
*Attorney, Agent, or Firm*—Michael V. Drew

[57] ABSTRACT

A package includes a plurality of cylindrical beverage cans (10) arranged into at least two tiers with a carton disposed around the cans. A paperboard divider panel (30) is disposed between and in contact with the cans of adjacent tiers. The divider panel includes a plurality of apertures (32), each of the apertures having a generally circular edge concentric with the cylindrical axis of upper and lower cans and having a diameter (D4) smaller than the base of the upper can. The divider panel further includes a substantially circular embossment (38) concentric with each of the apertures, the embossment having an outer diameter generally equal to the diameter of the top flange of the lower can.

6 Claims, 5 Drawing Sheets

CARTON HAVING DIVIDER PANEL FOR TWO-TIER CAN PACKAGE

RELATED APPLICATIONS

This application is a continuation-in-part of application Ser. No. 08/049,787, filed Apr. 19, 1993, now abandoned.

BACKGROUND OF THE INVENTION

The present invention relates generally to cartons formed from paperboard material for packaging beverage containers such as cans, and more particularly to such cartons for packaging beverage cans in two or more tiers.

In modern beverage packaging, one of the most common forms of primary packaging is the drawn aluminum or steel can, most frequently holding twelve fluid ounces of beverage. Such cans include a generally cylindrical side wall with a lower end formed integrally with the side wall and connected to the side wall along a generally large radius of curvature to define a lowermost, generally circular base. The base is typically domed inwardly in its central portion for pressure resistance. An upper end is connected to the side wall, seamed thereto along a generally circular outer flange of a diameter greater than that of the base. The upper end includes a top surface recessed inwardly with respect to the uppermost portions of the flange.

It is common to market such beverage cans in secondary, paperboard packages containing a multiple of cans. Such cans are normally arranged in a single tier, with a common multiple being twelve cans, arranged in a 3×4 array. However, higher multiples such as 24 or more cans may also be packaged in a single carton. Especially at such higher multiples, the carton can become awkwardly large in certain dimensions, and the single-tier arrangement also leaves four of six carton sides of relatively short height for the printing of graphics.

One solution to this problem is to package multiples of cans in two or more tiers. For example, a carton of 24 cans can be arranged as two tiers of 3×4 arrays in vertical alignment. Such a carton has the convenient perimeter of a twelve-pack carton, but double-height graphic area on its sides.

A multiple-tier can carton is not without disadvantages, however. Modern, high-speed packaging equipment requires the loading of cartons through one or both ends of a paperboard sleeve. In many machines, this results in the sliding or conveying movement of cans as they are loaded into the carton. For multiple tiers, either the cans are moved in a stacked condition, or the cans of upper tiers must be moved over the cans of an already arranged lower tier. However, this is difficult as a result of the can construction described above, as the cans will "nest" with the base of an upper-tier can fitting within the flange of the top of a lower-tier can. This problem can be overcome by moving already-stacked cans within the packaging machine, but the can-to-can contact and relative motion between stacked cans resulting in such an approach may be objectionable.

A second solution to this problem may be had by placing a divider panel between tiers of cans so that no vertical can-to-can contact occurs. Such an approach is generally known, as discussed in U.S. Pat. No. 3,351,264. There, a formed thermoplastic divider is used. However, especially for waste disposal and recycling reasons, it is preferable that the divider be made from paperboard sheet. The disadvantage to this solution is that while the outer carton may at first be tightly wrapped about the stacked cans, over time the upper tier of cans will depress the paperboard divider panel into the recessed top panel of the lower tier of cans. This will in effect "shrink" the height of the carton contents, yielding a looser carton.

What is needed, therefore, is a solution to the problem of separating multiple tiers of cans while avoiding the disadvantages resulting from collapse of the paperboard divider panel over time into the recessed portions of the cans upon which the divider panel rests. Of course, any such solution must not unduly complicate the packaging operation or the overall carton design or function.

SUMMARY OF THE INVENTION

In meeting the foregoing needs, the present invention provides a package including a plurality of beverage cans arranged into a group of at least two vertically-aligned tiers. Each can has a generally cylindrical side wall defining a cylindrical axis, and a lower end connected to the side wall along a generally large radius of curvature and defining a lowermost generally circular base of a first diameter. An upper end is connected to the side wall and includes a generally circular outer flange of a second diameter greater than the first diameter and a top surface recessed inwardly with respect to the flange. A carton is disposed around the exterior of the group of the cans and has side panels disposed substantially adjacent to the side walls of the cans of the group along opposite sides thereof, a top panel disposed substantially adjacent the upper ends of the cans of an uppermost of the tiers and foldably connected to the side panels, and a bottom panel disposed substantially adjacent the lower ends of the cans of a lowermost of the tiers and foldably connected to the side panels.

The invention further includes a paperboard divider panel disposed between and in contact with the cans of adjacent ones of the tiers. The divider panel defines a plurality of apertures, each of the apertures defined by a generally circular edge concentric with the cylindrical axis of upper and lower adjacent ones of the cans and having a diameter smaller than the first diameter. The divider panel further includes a substantially circular embossment concentric with each of the apertures, the embossment having an outer diameter generally equal to the second diameter to thereby cause the embossment to be depressed toward the lower adjacent one of the cans.

In use, the embossment enables the divider panel material to "wrap" over the flange of the lower can and extend into the recessed top surface of the can immediately beneath. This permits the paperboard to fully contact both the upper and lower can ends immediately upon stacking of the cans and prior to insertion of the stacked can arrangement into a carton sleeve. No vertical "shrinking" of carton contents will then occur within the loaded carton, and a tightly-packed carton will remain in such a condition.

In the package of the invention, each of the cans may include an opening means defined in the top surface and confined within a notional circle concentric with the cylindrical axis of the can and having a third diameter smaller than the first diameter, and wherein the circular edge is of a diameter greater than the third diameter.

Also, depending upon the vertical height of the can flange with respect to the can's recessed top surface, a second embossment formed concentric with and into the first embossment may be desirable to insure contact with both the upper and lower stacked cans.

According to an alternate definition, the invention may provide a carton for packaging a plurality of beverage cans, as previously defined, arranged into a group of at least two vertically-aligned tiers. The carton is disposed around the exterior of the group of the cans. The paperboard divider panel is disposed between and in contact with the cans of adjacent ones of the tiers. The divider panel defines a plurality of apertures, each of the apertures defined by a generally circular edge concentric with the cylindrical axis of upper and lower adjacent ones of the cans and having a diameter smaller than the first diameter. The divider panel further defines a plurality of slits arranged to extend radially outward from each circular edge to a distance at least equal to the second diameter.

Other advantages and objects of the present invention will be apparent from the following description, the accompanying drawings, and the appended claims.

DETAILED DESCRIPTION OF THE PREFERRED EMBODIMENT

Figure 1:
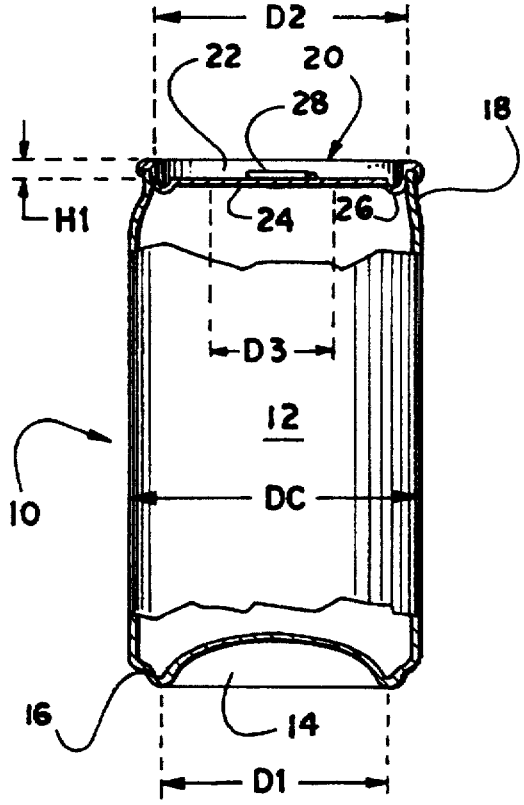
FIG. 1 is an elevational, partially sectional view of a typical beverage can as used with the present invention.

The present invention is intended primarily for use with drawn aluminum or steel cans of the type used in packaging beverages. A typical example of such a can is shown in FIG. 1, wherein can 10 includes a generally cylindrical side wall 12. Formed integrally with the side wall is a lower end 14 having a portion 16 connecting with side wall 12 which is of a relatively large radius of curvature. The bottommost surface of can 10 is domed inwardly.

At the upper end of side wall 12 is a necked-in portion 18, to which is attached the upper can end 20, seamed onto the can side wall along a flange 22. The can end includes a top surface 24 which is recessed below flange 22 by a distance H1, and a further recessed countersink 26 may be positioned between surface 24 and flange 22 for added strength. A conventional opening means 28, such as an attached pull-tab, is provided in the central portion of surface 24.

The lowermost portion of lower end 14 defines a circular base for the can having a diameter D1. Flange 22 at the upper end 20 of the can is of a diameter D2 which is greater than the base diameter D1 (although less than the overall can diameter DC). Thus, when stacked, the can base will nest within the upper end of the underlying can so that the base rests on top surface 24, and/or the curved connecting portion 16 rests against the inner surface of flange 22.

It should also be noted that opening means 18 is contained on top surface 24 within a notional circle of diameter D3 which is smaller than either D1 or D2.

In accordance with the invention, a package is provided wherein a plurality of cans 10 is loaded into a carton in a multi-tiered arrangement. An example of such a can arrangement can be seen by reference to FIG. 2. As shown therein, two-tiers of six cans each are arranged to provide a package containing twelve cans. Of course, it will be recognized that the invention may be used with any arrangement or number of cans for each tier, and may also be used for can arrangements having greater than two tiers.

In order to eliminate metal-to-metal contact between the tops and bottoms of the stacked cans, a divider panel 30 is placed between the tiers of cans, resting upon the top surfaces of the cans in the lower tier, while supporting the can bottoms of the upper tier. The divider panel 30 may be seen in plan view in FIG. 3. Panel 30 is provided with a plurality of apertures 32, one aperture for each stacked pair of cans in the can arrangement. As shown in FIG. 3, divider panel 30 is configured for use with the two-tier, 2×3 array of cans shown in FIG. 2. Preferably, the surface area of panel 30 is approximately equal to the cross-sectional area of a horizontal section of one tier of cans.

Each aperture 32 includes a circular edge 34. Circular edge 34 defines a diameter D4 which exceeds the diameter D3 containing the opening means 28 for a can, but is smaller than the diameter D1 of the lower can end. Formed concentrically about each aperture 32 is a substantially circular embossment 36. Embossment 36 has an outer diameter D5 which is substantially equal to the diameter D2 of can flange 22.

Figure 3:
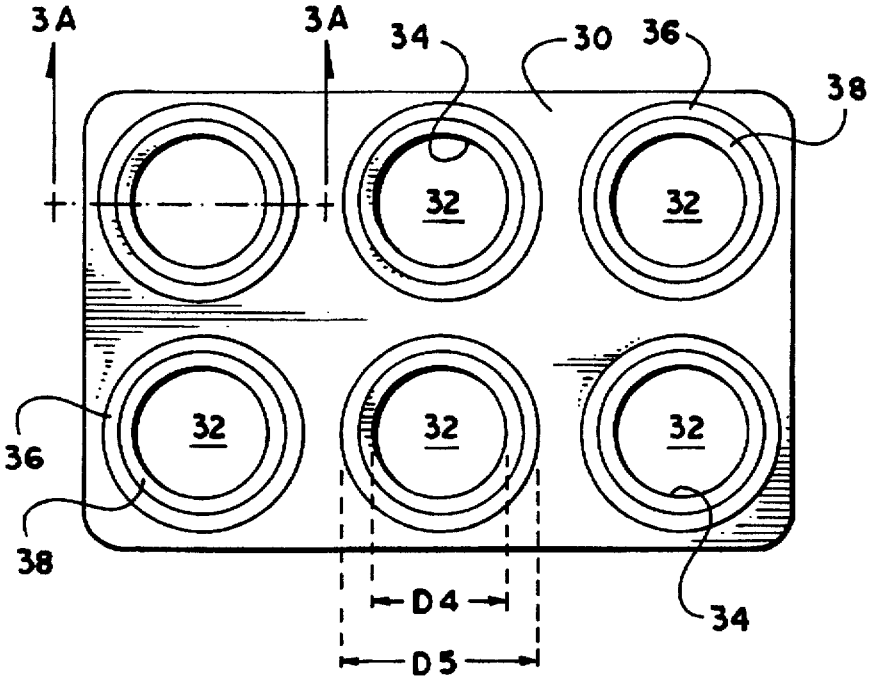
FIG. 3 is a plan view of the divider panel.
Figure 3A:
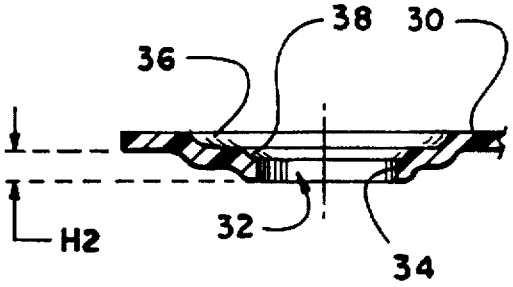
FIG. 3A is a partial sectional view of the divider panel, taken generally along 3A—3A in FIG. 3.

A second embossment 38 may be formed into, and concentrically with, embossment 36. Referring to FIG. 3A, it can be seen that embossments 36 and 38 together produce a depressed portion for divider panel 30 surrounding aperture 32 which extends below the surface of panel 30 by a distance H2.

Figure 4:
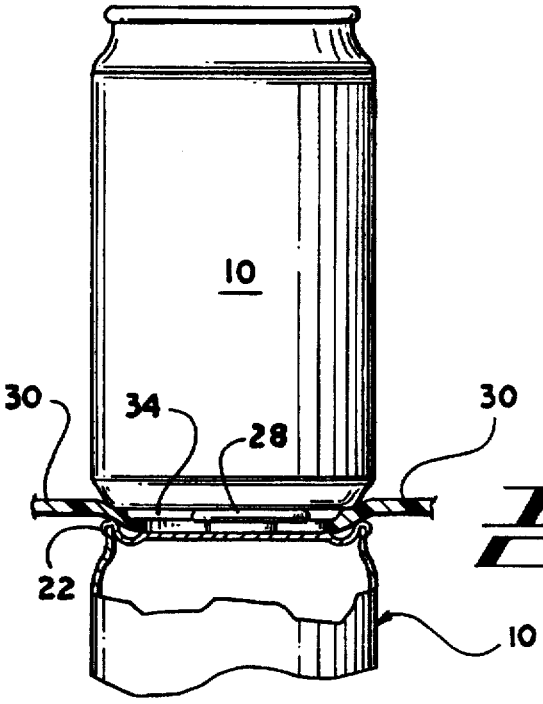
FIG. 4 is a sectional view showing placement of the divider panel between a stacked pair of cans.

The divider panel 30 may be seen in partial section and positioned between a pair of stacked cans by reference to FIG. 4. Because the diameter of the circular edge 34 exceeds that of the portion of the can upper end containing the opening means 28, divider panel 30 is not buckled or bulged as a result of any contact with the opening means 28. Since the diameter of embossment 36 is generally equal to that of the flange 22 on the lower can, paperboard material "wraps" the upper and inner surfaces of the flange. Because the embossments create a depression equal to the flange height, paperboard extends completely between the adjacent lower end of an upper can and upper end of a lower can, which would otherwise be in contact. This eliminates the downward compression of a solid divider panel under influence of the weight of the upper can, which would result in a disadvantageous "shrinking" of the height of a completed can arrangement.

It should be recognized that while at least one embossment 36 for each aperture 32 is required in the practice of the present invention, it may be that a single embossment is sufficient, thereby enabling embossment 38 to be eliminated. Alternatively, three or more embossments may be required. What is important is that the depression created by the embossing of divider panel 30 equal the height of the can flange 22. This permits the paperboard to be effectively completely "sandwiched" between the stacked cans, even when the cans and divider panel are first arranged in stacked condition. The exact number of embossments necessary, of course, will depend on factors such as flange height, paperboard flexibility and the like.

Figure 2:
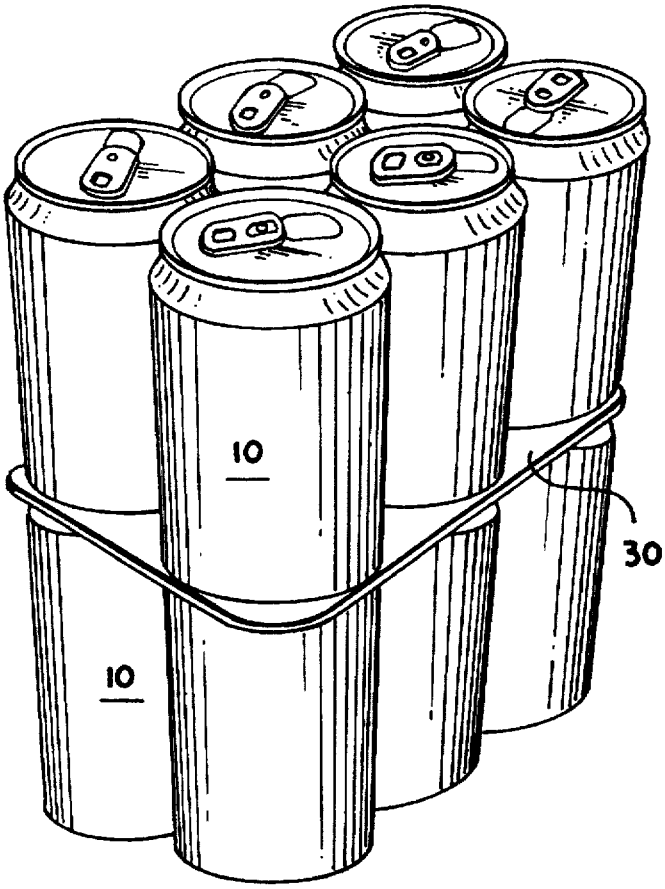
FIG. 2 is a perspective view of a two-tier arrangement of cans for placement within a carton in accordance with the present invention, showing the divider panel positioned between the tiers.

To complete the package, the can arrangement and divider panel 30 shown in FIG. 2 are placed into the interior of a sleeve-type carton, which may be an otherwise conventional carton used in the packaging of beverage cans.

Figure 5:
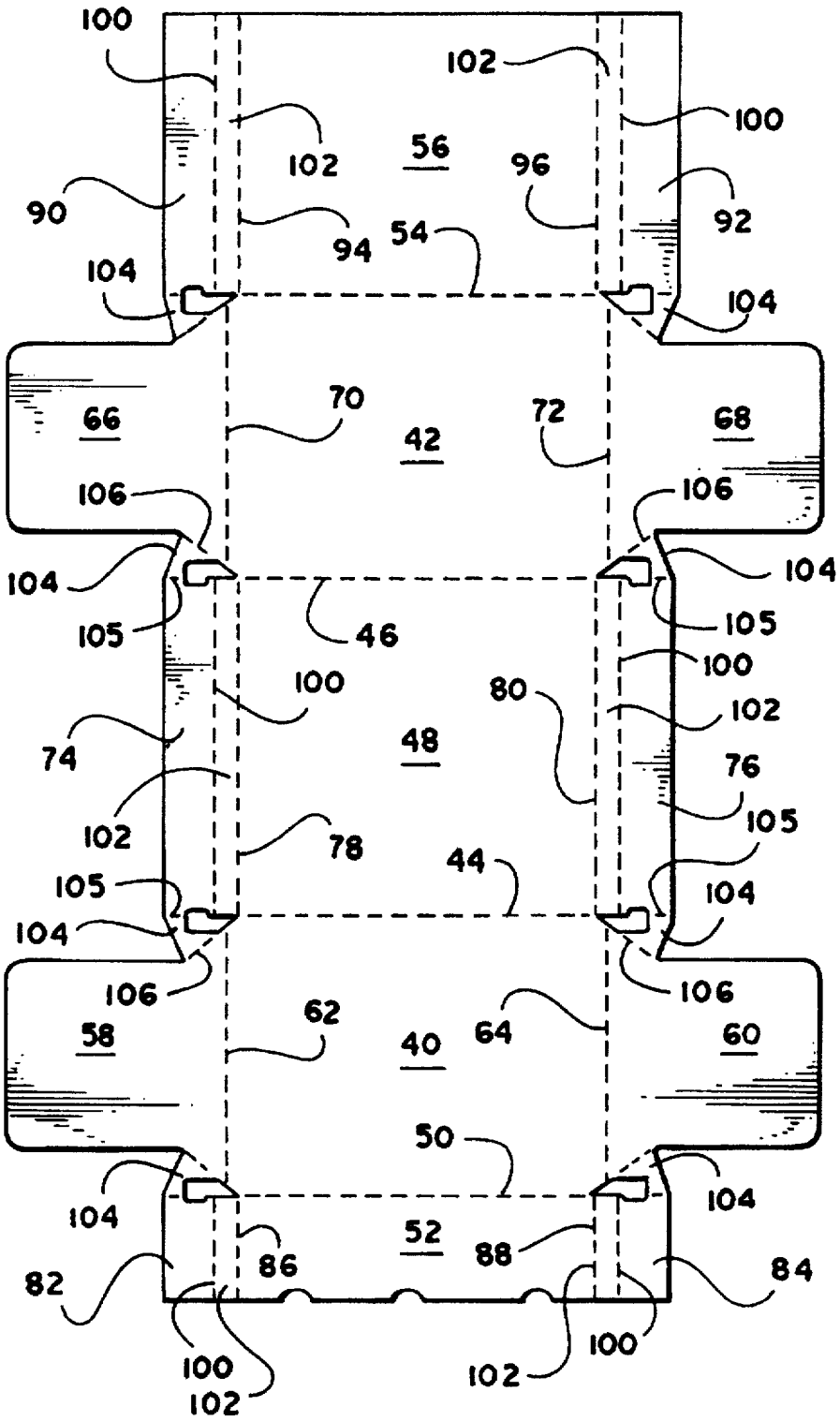
FIG. 5 is a plan view of the outer surface of a blank from which a carton in connection with the present invention may be formed.

A blank for one such carton may be seen by reference to FIG. 5. The carton includes a bottom panel 40 and a top panel 42, each connected along fold lines 44 and 46 respectively to a side wall 48. At its opposite side, bottom panel 40 is connected along fold line 50 to partial side wall panel 52, while top panel 42 is connected along fold line 54 to partial side panel 56.

End closure structure, in part, is provided for the carton in the form of end flaps 58 and 60 which are foldably joined to the end edges of bottom wall 40 along fold lines 62 and 64 respectively. In addition, end flaps 66 and 68 are foldably joined to the end edges of top wall 42 along fold lines 70 and 72 respectively. End flaps 74 and 76 are foldably joined to the end edges of side wall 48 along fold lines 78 and 80 respectively. Additional end closure structure is provided in the form of partial end flaps 82 and 84 which are foldably joined to the end edges of partial side wall 52 along fold lines 86 and 88 respectively. Likewise, partial end flaps 90 and 92 are foldably joined to the end edges of partial side wall 56 along fold lines 94 and 96 respectively.

Additional fold lines 100 are formed in end flaps 74 and 76 and partial end flaps 82, 84, 90 and 92 to define bevelled corner panels 102. In addition, each end flap 74 and 76 and partial end flaps 82, 84, 90 and 92 are foldably interconnected by a web structure 104 to the adjacent one of end flaps 58, 60, 66 and 68. Each web structure 104 is defined by a fold line 105 which is substantially collinear with the fold line connecting the top or bottom panel 40 or 42 to the respective one of the side panels 48, 52 or 56. Web structure 104 is further defined by a fold line 106 which extends at an angle inwardly with respect to the corresponding one of end flaps 58, 60, 66 and 68.

Further details regarding the specific construction of the carton blank may be seen by reference to U.S. Pat. No. 4,216,861, which is hereby incorporated by reference.

Figure 6:
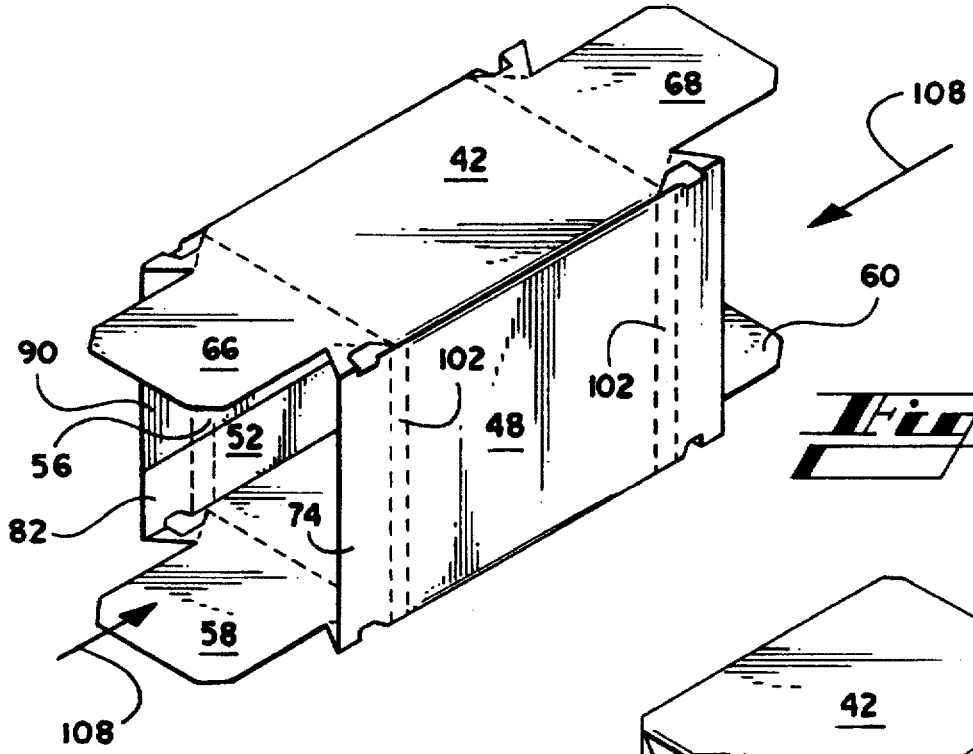
FIG. 6 is an erected sleeve formed from the blank of FIG. 5.
Figure 7:
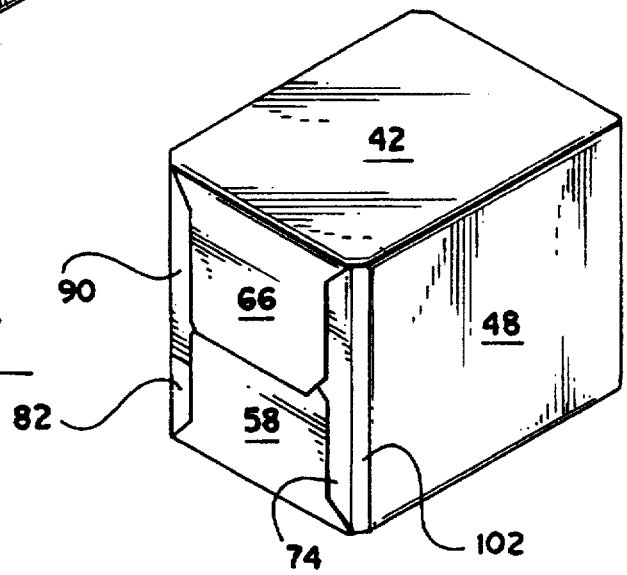
FIG. 7 is a completed package in accordance with the present invention.

The carton blank of FIG. 5 may be erected into a tube as shown in FIG. 6 by gluing the partial side panels 52 and 56 together to form a completed side wall. The tubular carton, as shown in FIG. 6, may then be loaded with the can arrangement and divider plate through one or both of its ends as illustrated by arrows 108. The carton end flaps are then closed and glued into position using conventional methods, thereby producing the completed package shown in FIG. 7. Further details regarding the folding sequence of the end flaps of the carton may be found by reference to the aforementioned U.S. Pat. No. 4,216,861.

Figure 10:
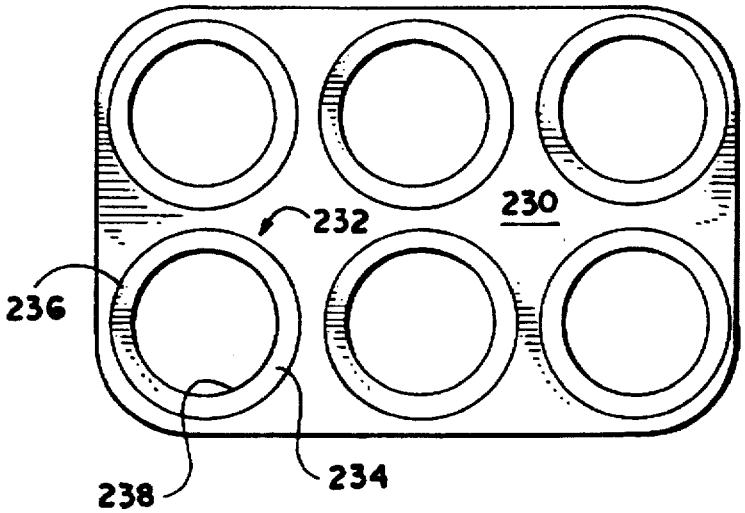
FIG. 10 is a plan view of a divider panel having embossments made by the assembly.
Figure 8:
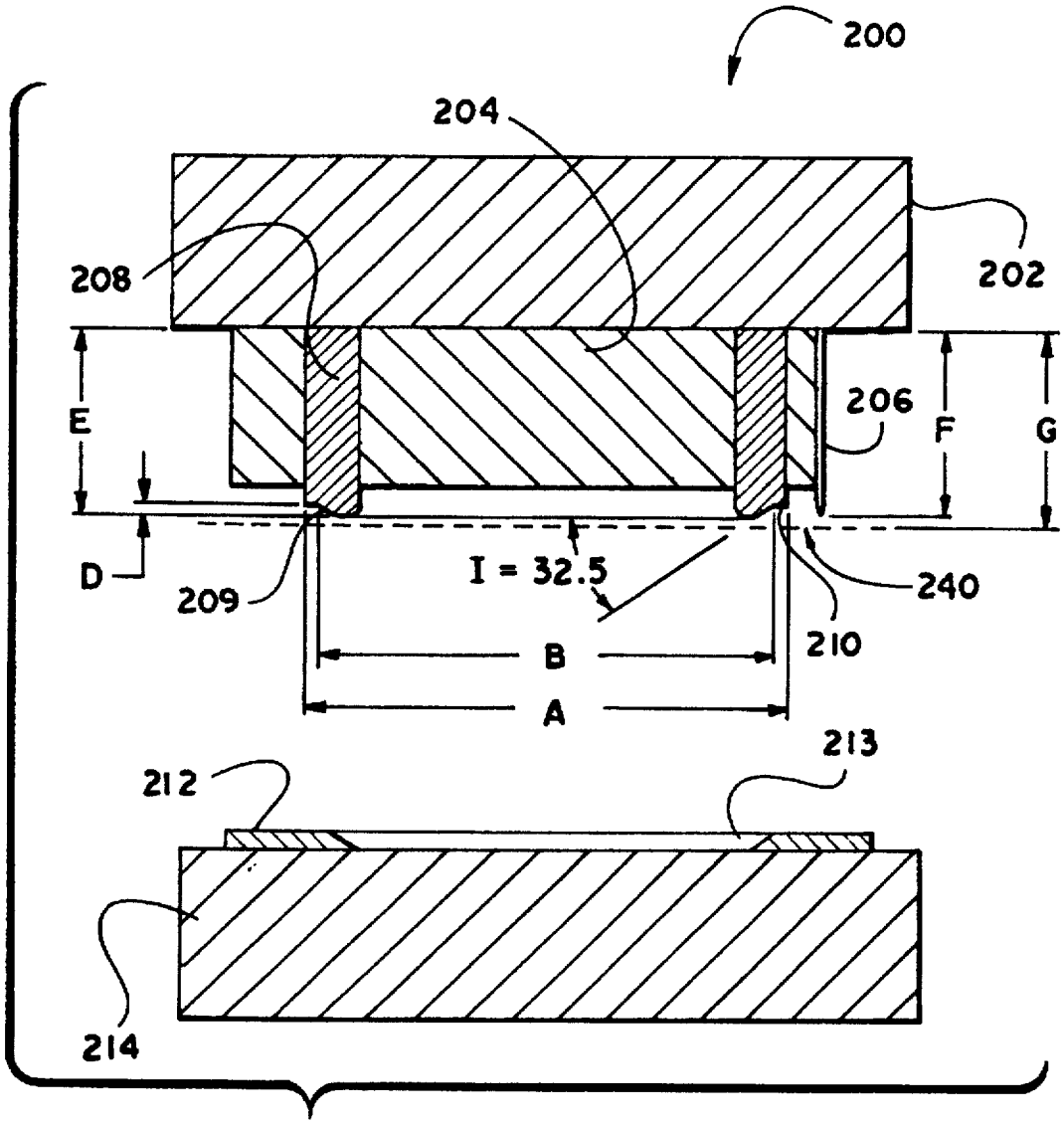
FIG. 8 is a sectional illustration of a die for embossing and cutting an insert panel in accordance with the present invention.
Figure 9:
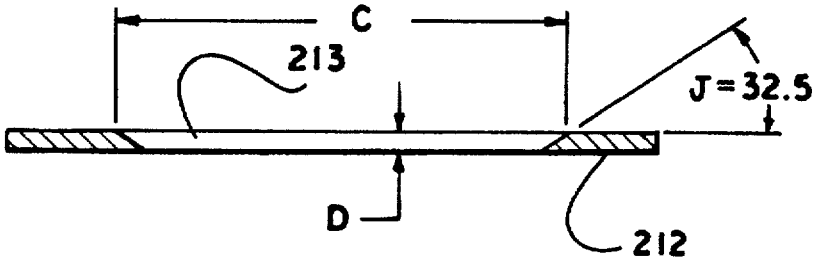
FIG. 9 is the female embossing plate illustrated in FIG. 8 in sectional illustration.

Embossments 36 and 38 are formed prior to placement of the divider panel 30 onto the lower tier of cans, preferably during its manufacture, and may be formed by known, conventional techniques. For example, the embossments may be conveniently formed using a press die machine, which is a conventional die cutting machine having a pressing die fitted thereto. Referring now to FIGS. 8, 9 and 10, according to a different aspect of the present invention another means of forming embossments is through a one-step stamping process utilizing a die 200 containing cutting 206 rules (and possibly scoring and perforation rules) as well as a corresponding pair of a male embossing member 209 and female embossing plate 212. FIGS. 8 and 9 illustrate the die 200 components while FIG. 9 illustrates a typical panel 230 formed by the die 200. For simplification of explanation, a single circular embossment 232 is illustrated as formed by the die 200 upon the insert panel 230. For a dual or multiple embossment, the embossing elements of the die 200 are multiplied. The upper platen 202 of the die 200 has mounted upon it a stabilizing block 204 of material such as wood in which are embedded cutting 206 rules and a male embossing member 208. The embossing member 208 is cylindrical in the embodiment illustrated in order to form a circular embossment 232 to accommodate cylindrical cans. For other uses, other male shapes may be used to form correspondingly different shapes of embossments. The end of the embossing member 208 has a bevelled, or inclined, wall 209 that creates an annular protrusion above a generally flat annular portion 210. The width of the flat annular portion is the difference between the outer diameter A and diameter B. The bevelled wall 209 may be positioned at any angle small enough to prevent tearing or shearing of a sheet of paperboard being embossed but great enough to achieve definitive, permanent embossment. The angle I formed by the inclined wall 209 with respect to a horizontal reference plane of the die 200 is equal to the angle J formed by the bevelled wall 213 of the depression of the embossing plate 212 with respect to a horizontal reference plane of the die 200. An angle of about 32.5 degrees works well to properly form the inclined wall 234 of the circular embossment 232 to accommodate beverage cans. The protruding portion of the male embossing member 208 is receivable by a corresponding depression formed in the embossing plate 212. The depression is essentially formed by an inclined wall 213 corresponding to the inclined wall 209 of the embossing male member 208. To create a well-defined perimeter 236 for the circular embossment 232, the diameter C of the depression of the female embossing plate 212 is less than the outer diameter A of the male embossing member 208 but greater than the diameter B of the male embossing member 208 which defines the outer edge of the protruding portion of the male embossing member 208. The protruding portion of the male embossing member 208 extends below the flat edge 210 formed at the outer ring by a depth D. The depression of the embossing plate has a corresponding depth D. The overall length E of the male embossing member 208 is greater than the length of the cutting rule 206. The length F of the cutting rule 206 is slightly greater than the length (E minus D) of the flat outer annular portion 210 of the male embossing member. A platen reference line 240 illustrates the distance between the lower surface of the upper platen 202 and the top surface of the lower platen 214 which supports the female embossing plate when the two platens 202, 214 are moved to their closest position facing one another to cut and emboss a sheet of paperboard. In operation, a sheet of paperboard is inserted between the male member 208 and female plate 212 and the platens 202, 214 are moved together to their closest face-to-face position as described above. When the two platens 202,214 are pressed together in this manner sandwiched paperboard is simultaneously cut by the cutting rule 206 and embossed by the male 208 and female 212 embossing members. As briefly mentioned above, the die 200 may also include scoring and perforating rules to simultaneously score and perforate a sheet of paperboard when cut and embossed.

It will be recognized that many variations may be made to the foregoing within the scope of the present invention. For example, alternate carton styles may be used, such as those having square corners rather than the bevelled corners as shown herein. Further, the carton design may be enhanced through the addition of handles, opening means and the like, again using structures known and understood within the art.

It should be further recognized that it would be possible to replace the single divider panel 30 with two or more divider panels, each being positioned between portions of the stacked can arrangement. Such an approach may be particularly useful where higher multiples of cans are desired to be placed within the carton, and/or where loading of the carton from both of its open ends is desired.

Other modifications may be made in the foregoing without departing from the scope and spirit of the claimed invention.

We claim:

1. A package comprising:

a plurality of beverage cans arranged into a group of at least two vertically-aligned tiers, each can having a generally cylindrical side wall defining a cylindrical axis, a lower end connected to said side wall along a generally large radius of curvature and defining a lowermost generally circular base of a first diameter, an upper end connected to said side wall and including a generally circular outer flange of a second diameter greater than said first diameter and a top surface recessed inwardly with respect to said flange;

a carton disposed around the exterior of said group of said cans and having side panels disposed substantially adjacent to said side walls of said cans of said group along opposite sides thereof, a top panel disposed substantially adjacent said upper ends of said cans of an uppermost of said tiers and foldably connected to said side panels, and a bottom panel disposed substantially adjacent said lower ends of said cans of a lowermost of said tiers and foldably connected to said side panels; and a divider panel disposed between and in contact with co-axially aligned ones of said cans of adjacent ones of said tiers, said divider panel defining a plurality of apertures extending through said divider panel, each of said apertures defined by a generally circular edge concentric with said cylindrical axis of upper and lower adjacent ones of said cans and having a diameter smaller than said first diameter, said divider panel further including a first substantially circular embossment concentric with each of said apertures, said first embossment having an outer diameter generally equal to said second diameter and further including a second substantially circular embossment formed into said first embossment to thereby cause said first embossment and said second substantially circular embossment to be depressed toward said lower adjacent one of said cans such that an apertured depressed portion of said divider panel extends below a surface of said divider panel by a predetermined distance.

2. A carton for packaging a plurality of beverage cans arranged into a group of at least two vertically-aligned tiers, each can having a generally cylindrical side wall defining a cylindrical axis, a lower end connected to said side wall along a generally large radius of curvature and defining a lowermost generally circular base of a first diameter, an upper end connected to said side wall and including a generally circular outer flange of a second diameter greater than said first diameter and a top surface recessed inwardly with respect to said flange, said carton comprising:

an exterior carton portion disposed around the exterior of said group of said cans and having side panels disposed substantially adjacent to said side walls of said cans of said group along opposite sides thereof, a top panel disposed substantially adjacent said upper ends of said cans of an uppermost of said tiers and foldably connected to said side panels, and a bottom panel disposed substantially adjacent said lower ends of said cans of a lowermost of said tiers and foldably connected to said side panels; and a divider panel disposed between and in contact with said cans of adjacent ones of said tiers, said divider panel defining a plurality of apertures extending through said divider panel, each of said apertures defined by a generally circular edge concentric with said cylindrical axis of upper and lower adjacent ones of said cans and having a diameter smaller than said first diameter, said divider panel further including a first substantially circular embossment concentric with each of said apertures, said first embossment having an outer diameter generally equal to said second diameter and additionally including a second substantially circular embossment formed into said first embossment to thereby cause said first embossment and said second substantially circular embossment to be depressed toward said lower adjacent one of said cans.

3. A method of forming a package, comprising the steps of:

arranging a plurality of beverage cans into a group of at least two vertically aligned tiers, each can having a generally cylindrical side wall defining a cylindrical axis, a lower end connected to said side wall along a generally large radius of curvature and defining a lowermost generally circular base of a first diameter, an upper end connected to said side wall and including a generally circular outer flange of a second diameter greater than said first diameter and a top surface recessed inwardly with respect to said flange;

placing a divider panel between and in contact with coaxially aligned ones of said cans of adjacent ones of said tiers, said divider panel defining a plurality of apertures extending through said divider panel, each of said apertures defined by a generally circular edge concentric with said cylindrical axis of upper and lower adjacent ones of said cans and having a diameter smaller than said first diameter, said divider panel further including a first substantially circular embossment concentric with each of said apertures, said first embossment having an outer diameter generally equal to said second diameter and further including a second substantially circular embossment formed into said first embossment, said divider panel being placed with said outer diameter of said first embossment overly said flange of said lower adjacent one of said cane to thereby cause said first embossment and said second embossment to be depressed toward said lower adjacent one of said cans; and placing said group of said cans, with said divider panel between said tiers thereof, into a carton having side panels disposed substantially adjacent to said side walls of said cans of said group along opposite sides thereof, a top panel disposed substantially adjacent said upper ends of said cans of an uppermost of said tiers and foldably connected to said side panels, and a bottom panel disposed substantially adjacent said lower ends of said cane of a lowermost of said tiers and foldably connected to said side panels.

4. A press die system for forming a divider panel comprising:

first die means having at least one cylindrical male embossing member extending from first platen means having a first end terminating in a frustum-shaped lip having an outer wall inclined at a first angle with respect to a first plane perpendicular to an axis of said cylindrical male member, said first end having an annular wall adjacent said frustum-shaped lip extending around an outer perimeter thereof lying in a second plane parallel to said first plane and at least one cutting rule; and second die means having at least one female embossing plate having a top surface generally parallel to said first plane and a frustum-shaped concavity corresponding to and adapted for generally receiving said frustum-shaped lip having a side wall inclined at a second angle with respect to a third plane parallel to said first plane equal to said first angle.

5. The press die system of claim 4, wherein said first angle and said second angle equal 32.5 degrees.

6. The press die system of claim 4, wherein said frustum-shaped lip protrudes beyond said annular wall a distance which is equal to a depth of said frustum-shaped concavity.

* * * * *

UNITED STATES PATENT AND TRADEMARK OFFICE

CERTIFICATE OF CORRECTION

PATENT NO. : 5,687,847

DATED : November 18, 1997

INVENTOR(S) : Will L. Culpepper; James R. Oliff

It is certified that error appears in the above-identified patent and that said Letters Patent is hereby corrected as shown below:

Column 8, line 53, change "overly" to --overlying";
Column 8, line 54, change "cane" to --cans--;
Column 8, line 66, change "cane" to --cans--.

Signed and Sealed this

Thirtieth Day of June, 1998

*Attest:*

Bruce Lehman

BRUCE LEHMAN

*Attesting Officer*

*Commissioner of Patents and Trademarks*